US006098360A

United States Patent [19]

Johnson

[11] Patent Number: 6,098,360

[45] Date of Patent: Aug. 8, 2000

[54] OFFSET WEB COMPOSITE BEAM

[76] Inventor: Clay C. Johnson, P.O. Box 599, Trinidad, Calif. 95570

[21] Appl. No.: 08/756,243

[22] Filed: Aug. 28, 1996

[51] Int. Cl.[7] ..... E04B 1/00

[52] U.S. Cl. ..... 52/283; 52/92.1; 52/92.2; 52/92.3; 52/246

[58] Field of Search ..... 52/283, 92.1, 92.2, 52/92.3, 246, 262, 289, 702, 236.6

[56] References Cited

U.S. PATENT DOCUMENTS

| | | | |
|---|---|---|---|
| 324,456 | 8/1885 | Carskadon | 52/92.1 |
| 991,751 | 5/1911 | Salfield . | |
| 1,236,635 | 8/1917 | Wells | 52/92.3 |
| 1,277,766 | 9/1918 | Stadelman . | |
| 1,372,206 | 3/1921 | Stadelman | 52/92.1 |
| 1,459,761 | 6/1923 | Andrews . | |
| 1,504,454 | 8/1924 | Tyson | 52/236.6 |
| 1,514,398 | 4/1924 | Steinbrenner . | |
| 1,741,219 | 12/1929 | Bemis | 52/283 |
| 2,042,370 | 5/1936 | Walker | 20/1 |
| 2,076,650 | 4/1937 | Kettron | 52/236.6 |
| 2,235,811 | 3/1941 | Davison | 52/283 |
| 2,297,058 | 9/1942 | Hasenburger | 20/1 |
| 2,308,248 | 1/1943 | Rehn | 20/4 |
| 2,372,768 | 4/1945 | Davison | 52/289 |
| 2,653,356 | 9/1953 | Brannon | 52/262 |
| 2,702,413 | 2/1955 | Kamisato | 20/2 |
| 3,206,903 | 9/1965 | Johnson | 52/648 |
| 3,251,162 | 5/1966 | Strimple | 52/223 |
| 3,308,583 | 3/1967 | Chaney | 52/92 |
| 3,421,270 | 1/1969 | Chaney | 52/90 |
| 3,470,665 | 10/1969 | Perrault | 52/278 |
| 3,609,936 | 10/1971 | Toscano | 52/741 |
| 3,719,016 | 3/1973 | Randolph | 52/236 |
| 3,791,082 | 2/1974 | Bowling | 52/79 |
| 4,227,336 | 10/1980 | Misterka | 46/12 |
| 4,251,965 | 2/1981 | Powers | 52/289 |
| 4,320,604 | 3/1982 | O'Hanlon | 52/92 |
| 4,974,380 | 12/1990 | Bernander | 52/235 |
| 5,175,968 | 1/1993 | Saucke | 52/223 |
| 5,333,426 | 8/1994 | Varoglu | 52/236.7 |

*Primary Examiner*—Michael Safavi

[57] ABSTRACT

A composite beam for building construction where top cord (21) and bottom cord (23) are attached to web (22) to provide support along top edge or support along bottom cord (33). In addition, a single cord beam such as perimeter roof beam (60) comprised of bottom cord (62) attached to web (61) provides support along bottom cord (62) for roofing members (63). In addition, a single top plate (70) comprised of web (72) and top plate (71) provides support along top of plate (71).

1 Claim, 7 Drawing Sheets

30
31
32
33
34
34
34
35
35
35

40
41
42
51
51
50
49
44
44
46
46
48
43
47
45
45
45
45

56
56
55
54
53
52
50
49
42
44
45
45
45
46
43

OFFSET WEB COMPOSITE BEAM

BACKGROUND—FIELD OF INVENTION

This invention relates to frame construction of buildings, specifically to an improved composite beam for support of walls, floors and roofs.

BACKGROUND—DESCRIPTION OF PRIOR ART

Present wood frame building construction consists of many separate components, some of which are cut and assembled at the construction site. These components are assembled into a frame of walls, floors and roofs. The frame is often sheathed with plywood or oriented strand board (OSB) to provide lateral bracing to resist wind and seismic loads.

Beams within wood frame structures for floor beams or headers traditionally have been a single piece of sawn wood. Engineered wood products have made many improvements over traditional sawn wood beams. Engineered wood beams include laminated veneer lumber and parallel strand lumber and are available in longer lengths, larger sizes and higher uniformity than standard sawn lumber. Some examples of engineered wood products are sold under the trade marks of Parallam and Timberstrand. All of these engineered wood beams have only meant to replace the rectangular section shape of the traditional sawn wood beams and have not made improvements to the methods of assembly or weight reduction.

Several inventors have created types of beams that are improvements over engineered wood beams. Both U.S. Pat. No. 3,251,162 to Strimple (1966) and U.S. Pat. No. 5,175,968 to Saucke (1993) disclose methods of post tensioning steel rods in laminated wood beams; however, these beams are heavy and costly to manufacture.

Several inventors have created improvements to the rectangular section of beams. U.S. Pat. No. 3,791,082 to Bowling (1974) discloses a deep web plywood ridge beam; however, this beam does not provide a bearing surface for rafters nor does it integrate well with conventional frame construction. U.S. Pat. No. 4,974,380 to Bernander et al. (1990) discloses a deep web beam of concrete construction with a thickened web to support a floor surface; however, this thickened web does not add any structural strength to the beam. U.S. Pat. No. 2,235,811 to Davison (1941) discloses an elaborate system for prefabricated building components. The wall unit of Davison's patent includes a deep web beam with a ledger along the bottom edge for support of floor framing; however, this ledger does not contribute any structural strength to the beam.

Wood frame building, and the beams within, heretofore known suffer from one or more disadvantages:

(a) Beams of simple rectangular section use an excessive amount of wood fiber for a given required strength. This also results in excessive weight of the beam compared to a webbed beam with top and bottom cords.

(b) There are excessive number of parts to cut and assemble. Double top plates, rim joists, blocking are an example of the number of parts involved at a floor to wall junction.

(c) The large number of parts cut and installed increases the chances of construction errors occurring in the field.

(d) The large number of parts necessitates a substantial amount of skilled labor to install.

(e) The wall sheathing used in frame construction is only used to resist lateral loads.

OBJECTS AND ADVANTAGES

Accordingly, several objects and advantages of my invention are:

(a) to provide a lightweight beam by utilizing a deep web attached to a top and bottom cord which uses less wood fiber for a higher strength beam;

(b) to provide for this beam to integrate with both conventional and innovative framing methods in an efficient manner;

(c) to provide prefabricated structural components precut and ready to install;

(d) to provide structural components that will be uniform and cost effective to manufacture;

(e) to provide structural components that combine multiple parts and functions into one element which will result in reduced labor costs, increased uniformity, increased structural integrity;

(f) to provide structural components that makes multiple use of the wall sheathing in frame construction by utilizing said wall sheathing to resist both gravity and lateral loads.

Further objects and advantages of my invention will become apparent from a consideration of the drawings and ensuing description.

DRAWING FIGURES

DESCRIPTION OF THE PREFERRED EMBODIMENTS

Figure 2:
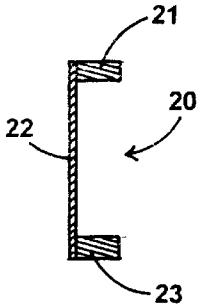
FIG. 2 is a section view of the offset web composite beam header as shown by the cut lines in FIG. 1.

The offset web composite beam fits within wall framing and provides support at the top or bottom edge of the beam. The components of the present invention align with, compliment or replace many conventional construction components. The present invention performs more functions with higher strength and greater continuity than the multiple conventional construction components that it replaces.

One embodiment of the offset web composite beam includes a longitudinal bottom tension cord and longitudinal top compression cord connected by a continuous shear transfer web. Another embodiment of the offset web composite beam includes a longitudinal bottom tension cord attached to a continuous shear transfer web that also functions as a top compression cord. Another embodiment of the offset web composite beam includes a longitudinal top compression cord attached to a continuous shear transfer web that also functions as a tension bottom cord.

In the present invention, in all embodiments, and as shown in all figures, said web is attached to the outer faces of top and bottom cords preferably by gluing or mechanical fasteners or by other means that may be advantageous. This assembly forms a deep web beam where the web preferably aligns with, and may structurally attach to, the wall sheathing found in frame building construction.

The top and bottom cords are preferably the same width and depth as other framing members in the building structure. Various embodiments of the present invention have a number of methods to be incorporated into a frame structure that will be shown in the following figures.

Throughout this text, the definition of mechanical fasteners shall include all available fastening systems such as, nails, screws, staples, as well as any other fasteners or systems that may be available in the future. Furthermore, the definition of gluing shall include all available chemically adhesive materials or systems, as well as any other adhesive or system that may be available in the future.

The material for the present invention is preferably of engineered wood. Throughout this text, the definition of engineered wood products includes all available engineered wood products, such as plywood, oriented strand board, laminated veneer lumber and parallel strand lumber, as well as those that may be fabricated in the future. Furthermore, the present invention may be, instead of engineered wood, constructed of a new composition concrete and plastic, or composition wood chips and plastic which may be discovered to be a satisfactory substitute for engineered wood; while still achieving substantially the same end result from a structural standpoint.

Other embodiments of the offset web composite beam with means and methods to integrate into frame construction are shown in the following figures. The embodiments shown are to illustrate various advantages and features of the novel invention presented and are intended as primary examples and not to be construed as restrictive in nature.

Reference Numerals in Drawings 20 offset web cornposite beam header
21 top cord
22 web
23 bottom cord
24 lower top plate
25 upper top plate
26 studs
30 offset web composite beam parapet wall/roof beam
31 topcord
32 web
33 bottom cord
34 vertical framing members
35 roof trusses
40 offset web composite perimeter floor beam
41 top cord
42 web -continued 43 bottom cord
44 edge blocking
45 floor joists
46 metal tie
47 post
48 support strap
49 floor sheathing
50 bottom plate
51 vertical framing members
52 offset web composite perimeter floor beam with continuous wall sheathing
53 edge blocking
54 receiving notch for studs
55 wall sheathing
56 studs
60 offset web composite perimeter roof beam
61 web
62 bottom cord
63 roof trusses
65 offset web composite plate/rim-joist/header
66 web
67 floor joists
68 floor sheathing
70 offset web composite single top plate
71 top cord/plate
72 web
73 studs
75 offset web composite beam top plate with continuous sheathing
76 edge blocking
77 wall sheathing
80 offset web composite perimeter floor beam with a downwardly extended web
81 top cord
82 web
83 ledger
84 floor joists
85 metal ties
86 floor sheathing
87 post
88 block Description-FIGS. 1 to 13

Figure 1:
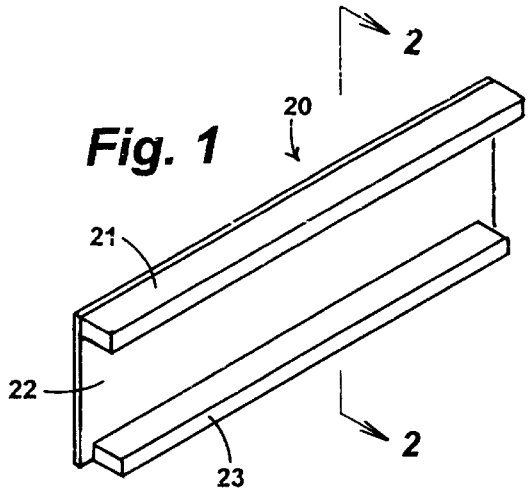
FIG. 1 is a perspective view of the offset web composite beam used as a header.
Figure 3:
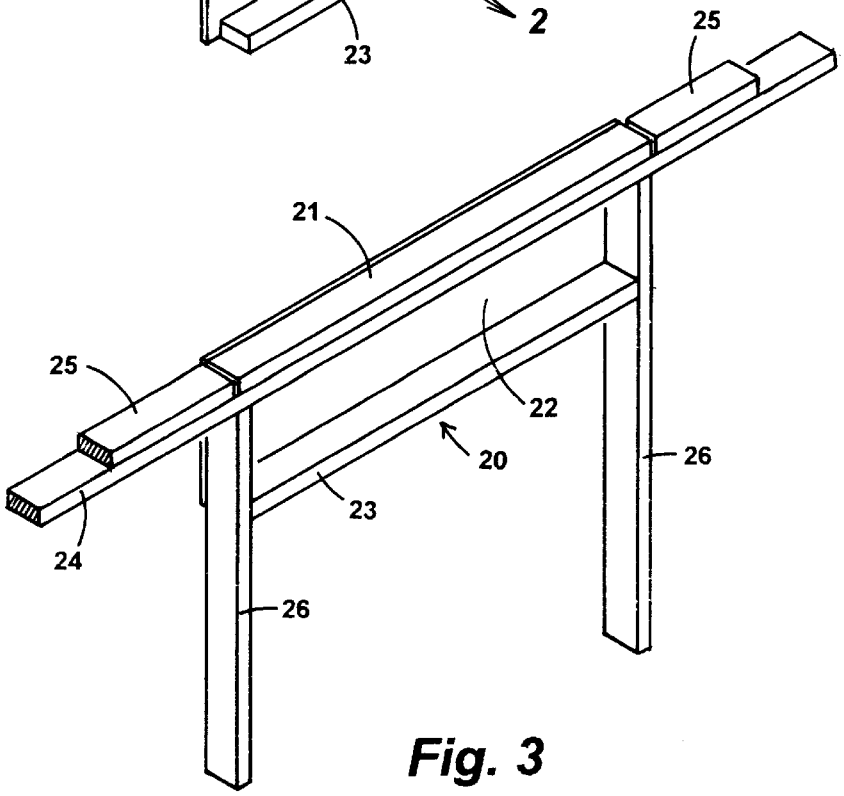
FIG. 3 is a perspective view of the offset web composite beam header as installed in a framed wall.

FIG. 1 shows the offset web composite beam as header 20. Height of web 22 extends from top of framed opening to top of wall. Length of web 22 extends from opposite outside faces of supporting studs 26 as shown in FIG. 3. Top cord 21 extends the entire length and is attached to upper inside face of web 22 by gluing or mechanical fasteners. Bottom cord 23 is attached to the bottom inside face of web 22 by gluing or mechanical fasteners. The length of bottom cord 23 is foreshortened at each end by the thickness of supporting stud 26.

FIG. 2 shows a sectional view of header 20 where the orientation of web 22 to top cord 21 and bottom cord 23 is apparent.

FIG. 3 shows header 20 installed in a framed wall. Studs 26 support conventional lower top plate 24 which may or may not be continuous. Top cord 21 of header 20 rests on, and is attached with mechanical fasteners to, lower top plate 24. The ends of top cord 21 bear directly over the top of supporting studs 26. Bottom cord 23 fits between, and is attached with mechanical fasteners to, the two opposite inside faces of supporting studs 26. Conventional upper top plates 25 are attached with mechanical fasteners to conventional lower top plate 24 to provide a flush top of wall. Web 22 laps over and is attached with mechanical fasteners to studs 26. Other wall framing and sheathing may be installed as necessary.

From FIGS. 1 through 3, it can be seen that header 20 has the advantages of not requiring conventional cripple studs, thus only one stud at the side of each opening is necessary. It can also be seen that header 20 is deeper, thus providing more strength, than a conventional header which would need to fit underneath the doubled top plates.

Figure 4:
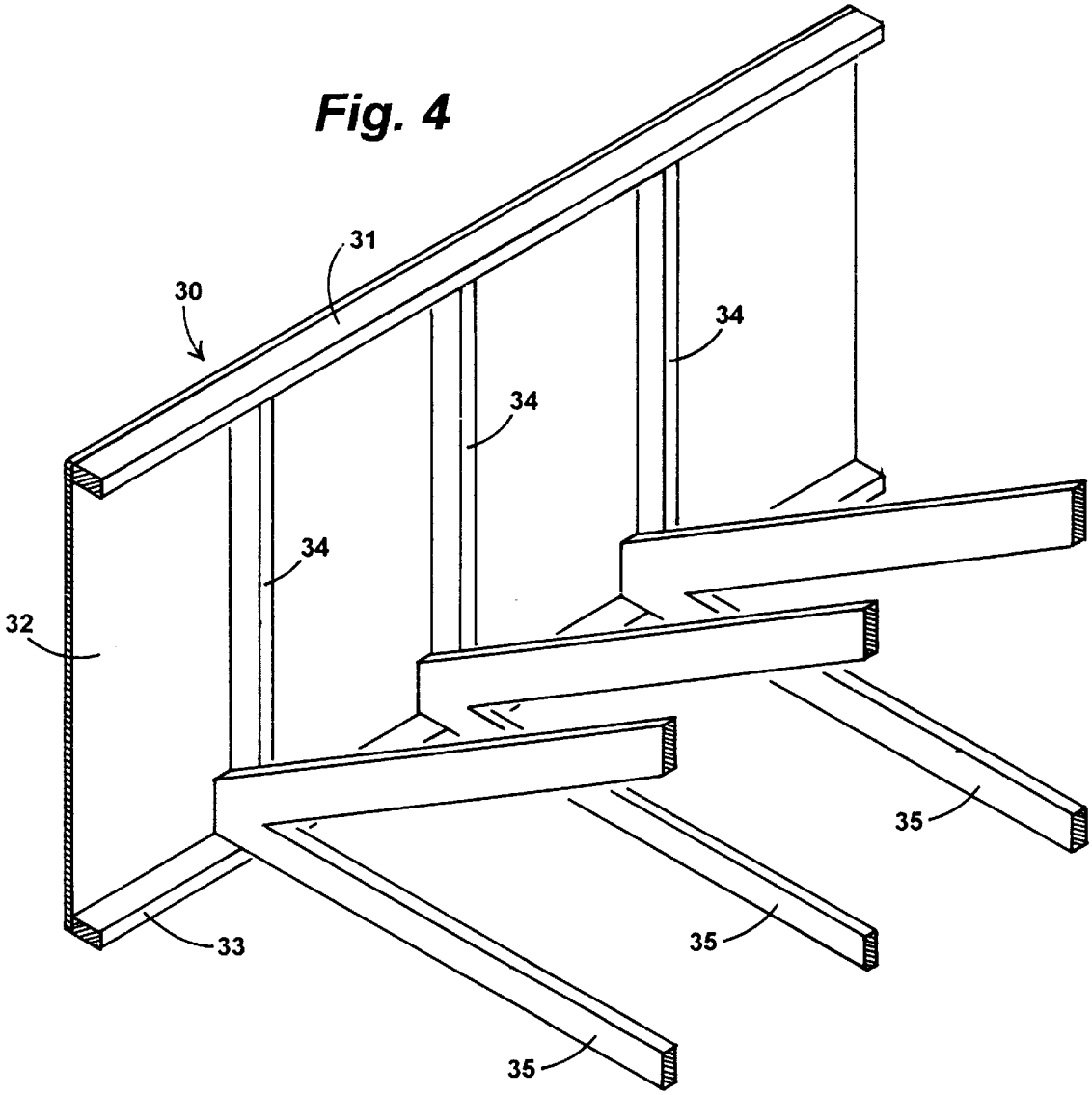
FIG. 4 is a perspective view of the offset web composite beam used as a parapet wall/roof beam that supports the ends of roof trusses.
Figure 12:
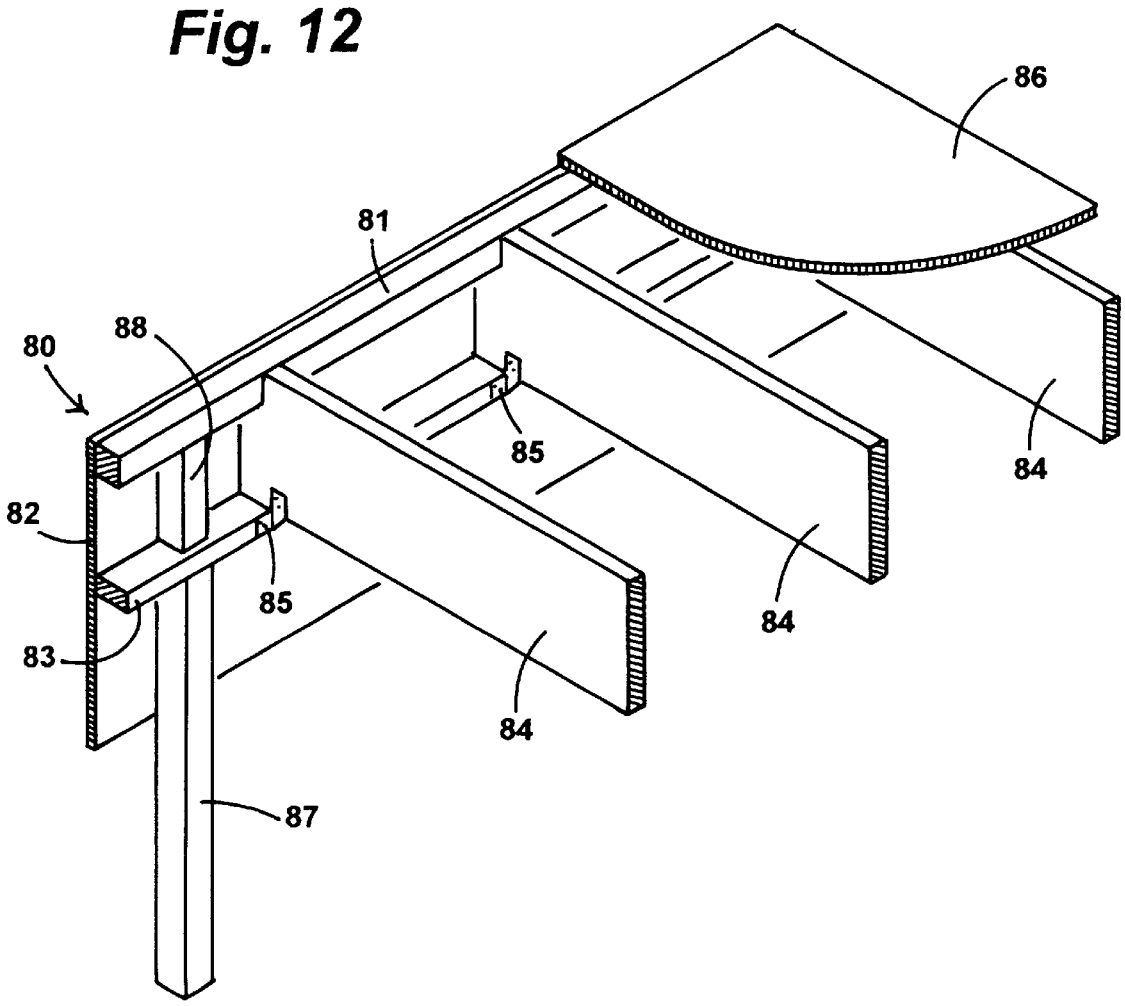
FIG. 12 is a perspective view of a variation of the offset web composite beam used as a perimeter floor beam with a downwardly extended web.

FIG. 4 shows another embodiment of the present invention as a portion of parapet wall/roof beam 30. Top cord 31 and bottom cord 33 are attached at the top and bottom of the inside face of web 32, as shown, by gluing or mechanical fasteners. Parapet wall/roof beam 30 extends continuously the length of the wall and is supported at the bottom cord 33 by conventional means similar to post 87 and block 88 as shown in FIG. 12, or at the top cord in a manner similar to the method shown in FIG. 3. Alternatively, beam 30 may be supported in a manner similar to the method shown in FIG. 5 by post 47.

Vertical framing members 34 may be factory or field installed and are attached to the web 32 by gluing or mechanical fasteners and attached to top and bottom cords 31 and 33 respectively by mechanical fasteners or metal ties as appropriate. The ends of a plurality of roof trusses 35, or rafters, bear on bottom cord 33 and attach to vertical framing members 34 and bottom cord 33 with mechanical fasteners or metal ties as appropriate.

From FIG. 4 it can be seen that parapet wall/proof beam 30 has the advantage of consolidating the functions of the parapet wall and a perimeter roof beam. A further advantage is making use of the extreme depth of the parapet wall for use as a deep web beam. A further advantage is providing a convenient and secure method of attachment and support for roof trusses 35 to beam 30 without the use of conventional joist hangers.

Figure 5:
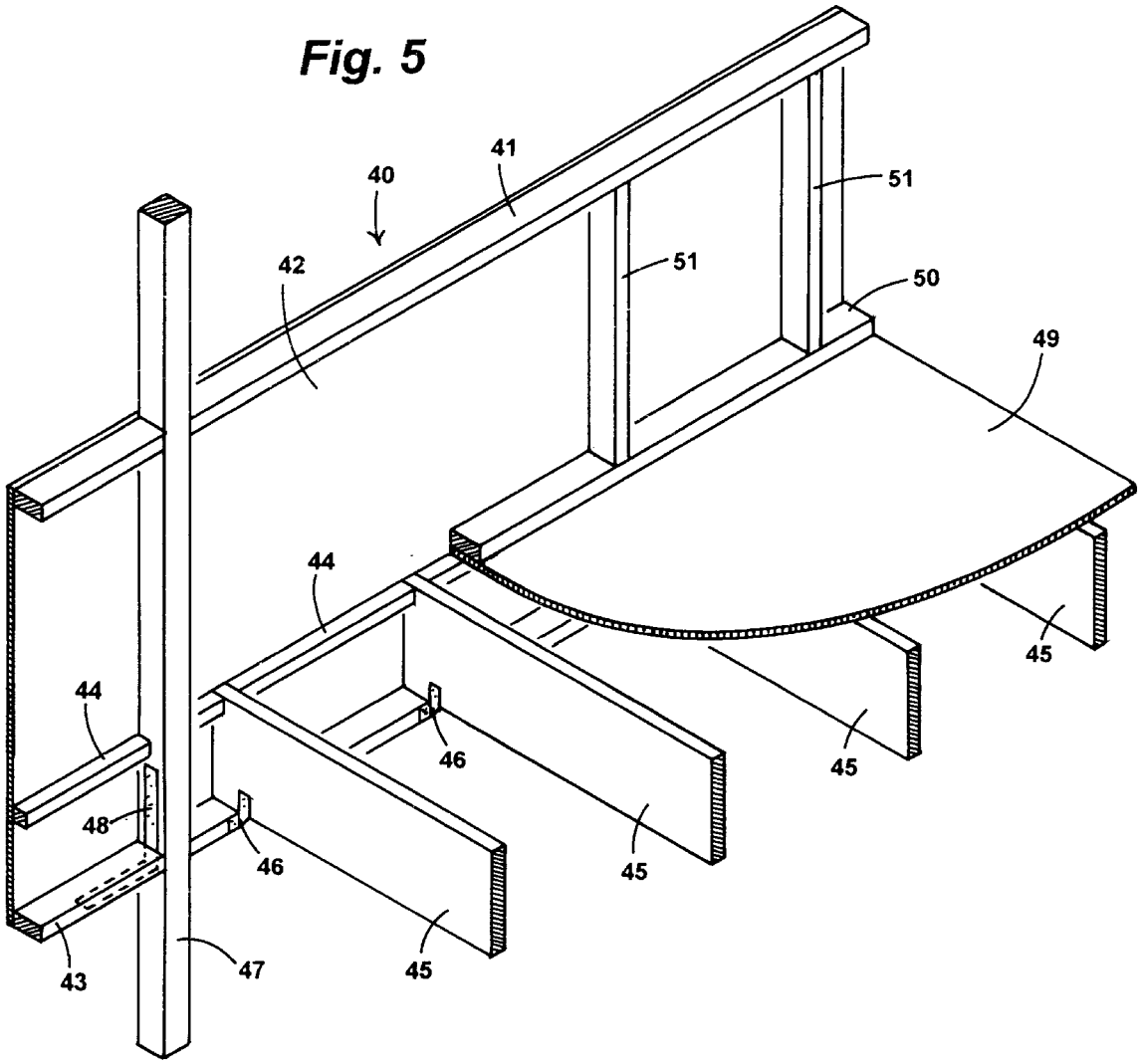
FIG. 5 is a perspective view of the offset web composite beam used as a perimeter floor beam.

FIG. 5 shows another embodiment of the present invention as a portion of perimeter floor beam 40. Top cord 41 and bottom cord 43 are attached at the top and bottom of the inside face of web 42 as shown by gluing or mechanical fasteners. The height of top cord 41 above floor sheathing 49 may be partial wall height where top cord 41 would define the bottom edge of window openings. Alternatively, top cord 41 may extend to the top of the wall where top cord 41 would also function as the top plate of the wall. Perimeter floor beam 40 extends continuously the length of the wall and is supported by a plurality of posts 47 with metal support straps 48 which are nailed to opposite faces of post 47 and the undersides of bottom cords 43. Only one support strap 48 is shown. Additionally, web 42 is attached to post 47 by mechanical fasteners and top cord 41 is attached to post 47 by mechanical fasteners or metal ties as appropriate. Alternatively, perimeter beam 40 may be supported at the bottom cord 43 by conventional means similar to post 87 and block 88 as shown in FIG. 12.

Floor joists 45 bear on bottom cord 43 and are attached to same with metal ties 46. Edge blocking 44 is installed between and flush with the top edge of floor joists 45 and may be factory or field attached to web 42 by gluing or mechanical fasteners. Edge blocking 44 provides lateral end bracing for floor joists 45 and provides a surface to edge-nail floor sheathing 49 (shown cut away). Edge blocking 44 also provides a means to transfer shear forces from floor sheathing to wall sheathing. Bottom plate 50 is installed after floor sheathing 49 in a conventional fashion with mechanical fasteners. Vertical framing members 51 may be factory or field attached to web 42 by gluing or mechanical fasteners.

Figure 6:
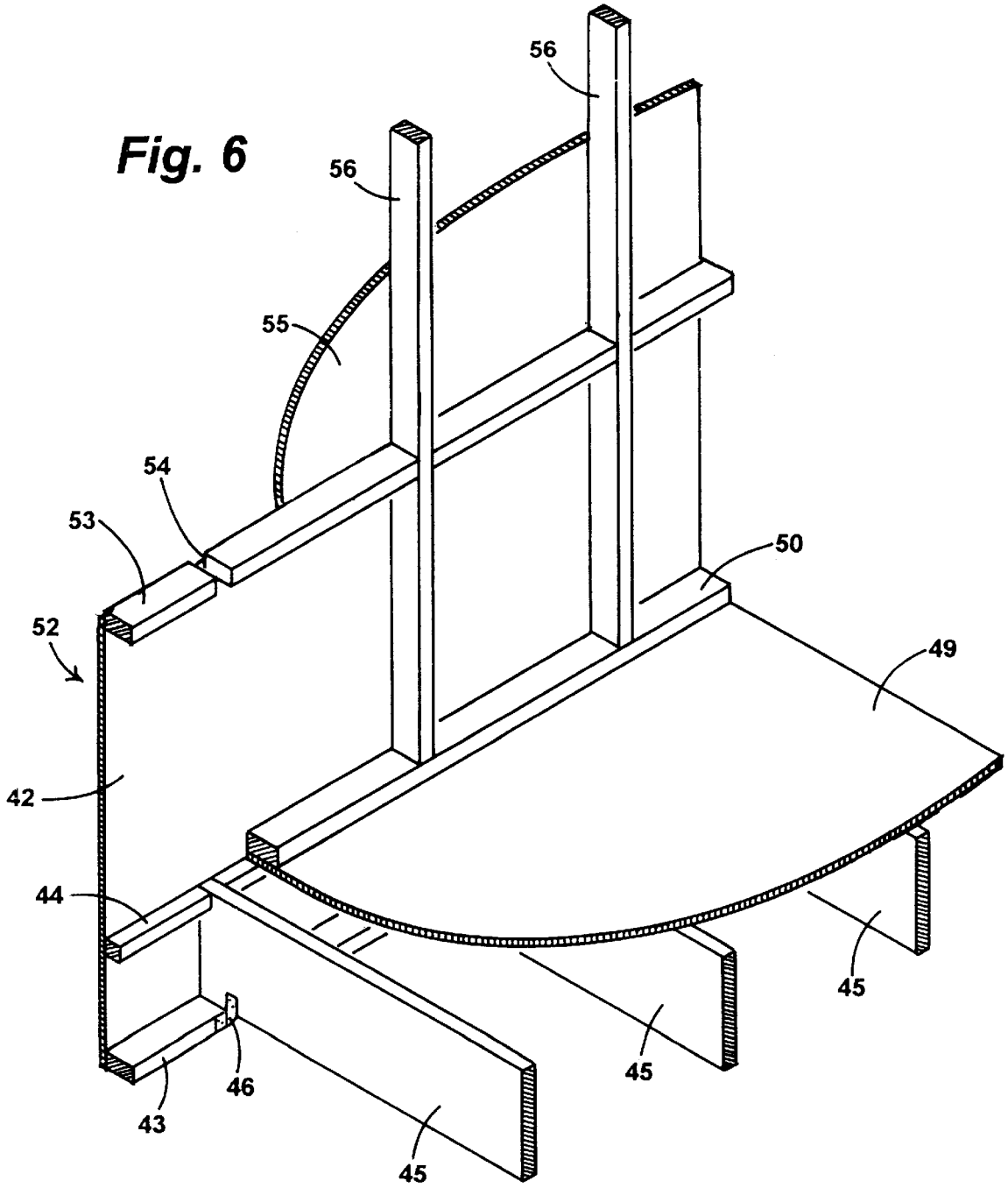
FIG. 6 is a perspective view of a variation of the offset web composite perimeter floor beam with full height studs.

FIG. 6 shows another embodiment of the present invention as a portion of perimeter floor beam with continuous wall sheathing 52, a variation of perimeter floor beam 40. The upper inside face of web 42 is attached to and laps approximately half of the outside face of edge blocking 53 by gluing or mechanical fasteners. Bottom edge of wall sheathing 55, shown cut away, is attached with mechanical fasteners to remaining exposed face of edge blocking 53. Receiving notches for studs 54 may be precut or field cut to allow full height studs 56 to be installed in notches 54 and between edge blocking 53. Both wall sheathing 55 and web 42 is attached to studs 56 with a plurality of mechanical fasteners.

From FIG. 5 and FIG. 6 it can he seen that perimeter floor beams 40 and 52 have the advantages of consolidating the functions of perimeter floor beam, rim joist, blocking and partial wall framing. A further advantage is making use of the extreme depth of the wall framing for use as a deep web beam. A further advantage is providing a convenient and secure method of attachment and support of floor joists 45 to perimeter beams 40 and 52 without the use of conventional joist hangers. A further advantage of perimeter floor beam 52 is providing for wall sheathing to conveniently attach to web 42 to be able to transfer shear from the top of wall into the web 42.

Figure 7:
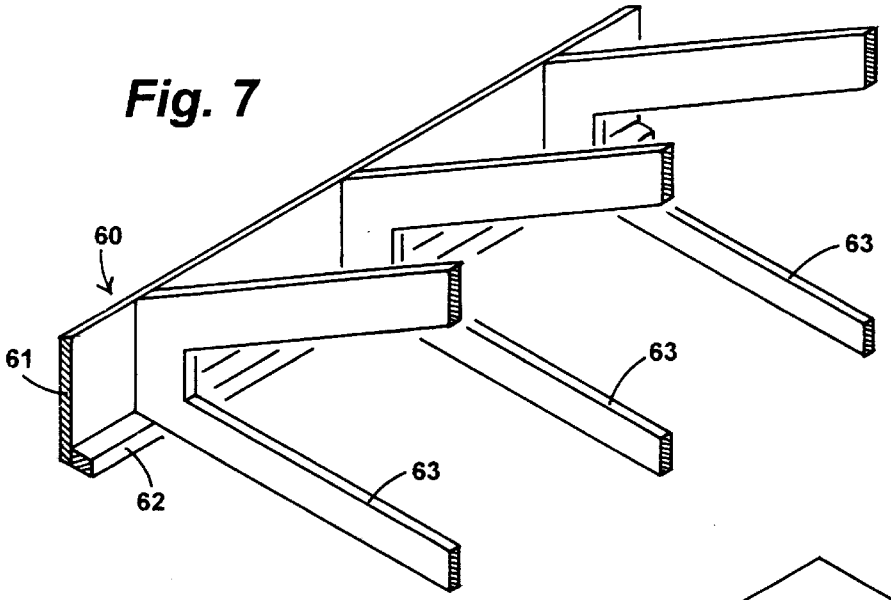
FIG. 7 is a perspective view of the offset web composite beam used as perimeter roof beam.

FIG. 7 shows another embodiment of the present invention as a portion of perimeter roof beam 60. Web 61 is attached to bottom cord 62 by gluing or mechanical fasteners to form perimeter roof beam 60 that runs continuously along the edge of roof Perimeter roof beam 60 is supported by conventional means. A plurality of roof trusses 63, or rafters, bear on bottom cord 62 and may be fastened to web 61 to provide lateral bracing for the roof trusses 63. Web 61 is made deep enough to align with the depth of roof trusses 63 or rafters. The top edge of web 61 is cut at an angle to align with the slope of the roof framing to provide for roof sheathing (not shown) to be nailed into the top edge of web 61. The thickness of web 61 is to be made adequate to provide for the roof sheathing nailing and as required for strength characteristics.

From FIG. 7 it can be seen that perimeter roof beam 60 has the advantages of consolidating the functions of perimeter roof beam, rim joist, and top plate. Roof beam 60 also replaces headers that would be located below the edge of roof. A further advantage is providing a convenient and secure method of attachment and support of roof trusses 63, or rafters, to perimeter roof beam 60 without the use of conventional joist hangers. Perimeter roof beam 60 demonstrates the use of the offset web composite beam with a bottom cord 62 and web 61 without a separate top cord. In this use the upper portion of the web 61 performs the duty of the top compression cord of the beam. The web 61 is thickened to assume this duty.

Figure 8:
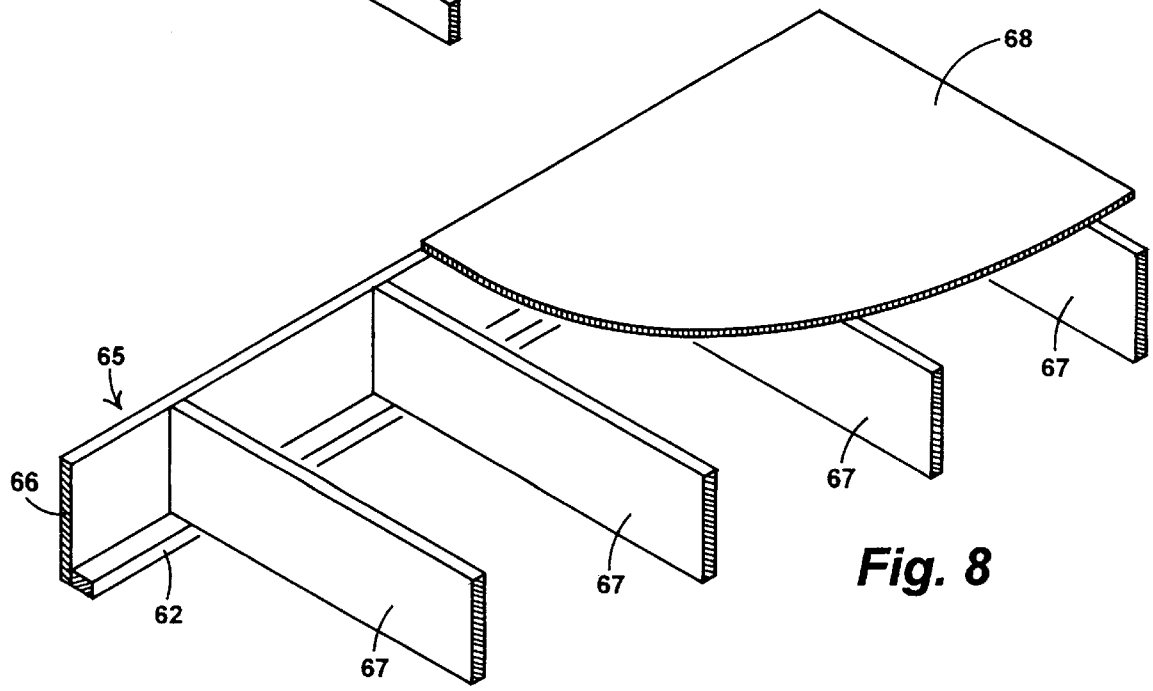
FIG. 8 is a perspective view of the offset web composite beam used as combined plate/rim-joist/header.

FIG. 8 shows another embodiment of the present invention as a portion of plate/rim-joist/header 65. Web 66 is attached to bottom cord 62 by gluing or mechanical fasteners to form plate/rim-joist/header 65 that runs continuously along the edge of floor. Plate/rim-joist/header 65 is supported by conventional means. A plurality of floor joists 67 bear on bottom cord 62 and may be fastened to web 66 to provide lateral bracing. Web 66 is made deep enough to align with the depth of floor joists 67. The thickness of web 66 is to be made adequate to provide for the floor sheathing 68 edge nailing and as required for strength characteristics.

From FIG. 8 it can be seen that plate/rim-joist/header 65 has the advantages of consolidating the functions of perimeter floor beam, rim joist, header, and top plate. A further advantage is providing a convenient and secure method of attachment and support of roof trusses 63, or rafters, to perimeter roof beam 60 without the use of conventional joist hangers. Plate/rim-joist/header 65 demonstrates the use of the offset web composite beam with a bottom cord 62 and web 66 without a separate top cord. In this use the upper portion of the web 66 performs the duty of the top compression cord of the beam. The web 66 is thickened to assume this duty.

Figure 9:
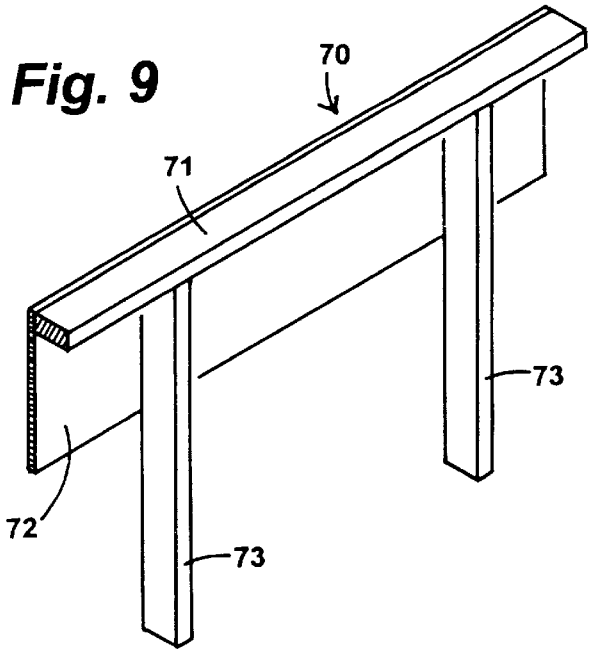
FIG. 9 is a perspective view of the offset web composite beam used as a single top plate.

FIG. 9 shows another embodiment of the present invention as a portion of single top plate 70. Top cord 71 is attached to the upper inside face of web 72 by gluing or mechanical fasteners to form single top plate 70 that runs continuously along the top of a framed wall. A plurality of studs 73 are installed in a conventional manner by attachment to single top plate 71 and web 72 with mechanical fasteners. The depth and thickness of web 72 is designed to accommodate the gravity load on the top of the plate and the spacing of the studs 73. When web 72 is made deeper or thicker, single top plate 70 becomes stronger when functioning as a beam and therefore the studs 73 may be spaced at greater intervals, thus affording greater economy of material and installation labor. In this embodiment the bottom portion of web 72 performs the duty of the bottom tension cord of the single top plate 70. When the single top plate 70 is loaded as a simple beam the bottom portion of web 72 is in tension, therefore self aligning, and therefore it is not required to provide blocking at the bottom edge of web 72.

Figure 10:
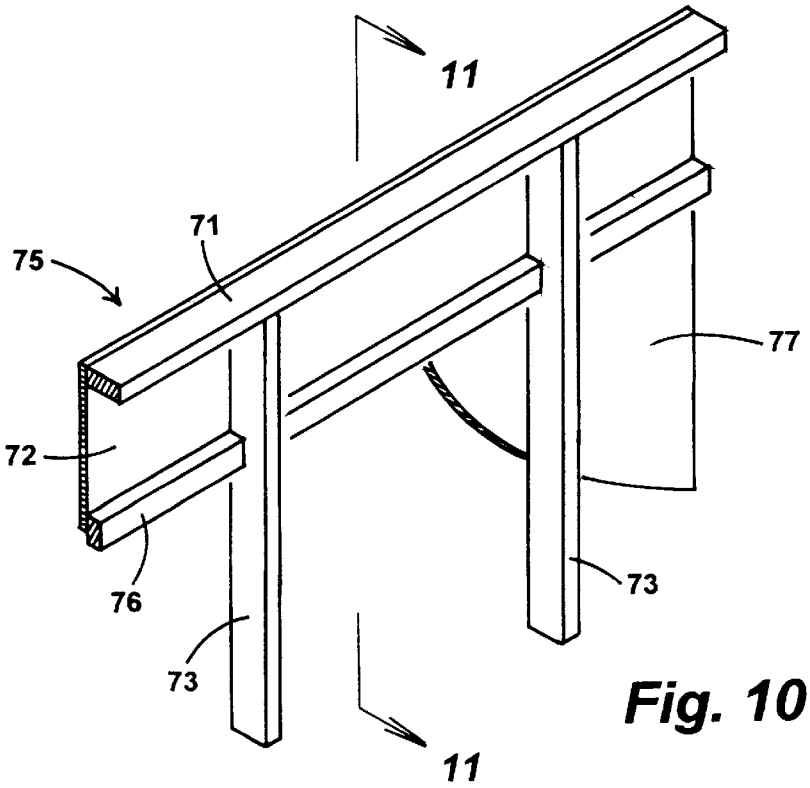
FIG. 10 is a perspective view of a variation of the offset web composite beam top plate with continuous sheathing.

FIG. 10 shows another embodiment of the present invention as a portion of single top plate with continuous sheathing 75, a variation of single top plate 70. Web 72 is attached to top cord 71 by gluing or mechanical fasteners to form single top plate 70 that runs continuously along the top of a framed wall. A plurality of studs 73 are installed in a conventional manner by attachment to single top plate 71 and web 72 with mechanical fasteners. The lower inside face of web 72 is attached to and laps approximately half of the outside face of edge blocking 76 by gluing or mechanical fasteners. Top edge of wall sheathing 77, shown cut away, is attached with mechanical fasteners to remaining exposed face of edge blocking 76. Receiving notch for studs 73 may be precut or field cut to allow full height studs 73 to be installed between edge blocking 76. Wall sheathing 77 is attached to studs 73 and edge blocking 76 with a plurality of mechanical fasteners.

Figure 11:
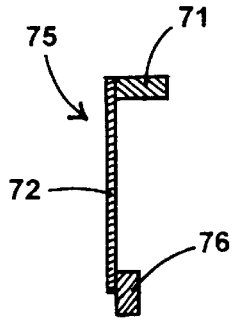
FIG. 11 is a section view of the offset web composite beam top plate with continuous sheathing as shown by the cut lines in FIG. 10.

FIG. 11 shows a sectional view of single top plate with continuous sheathing 75 where the orientation of web 72 to edge blocking 76 is apparent.

From FIG. 9 it can be seen that single top plate 70 has the advantages of consolidating the functions of a doubled top plate and increasing the spacing of studs 73. Single top plate 70 also replaces headers that would be located under same between studs 73. From FIG. 10 and FIG. 11 it can be seen that single top plate with continuous sheathing 75 has the same advantages as single top plate 70 in addition to the advantage of structurally connecting to wall sheathing 77. The advantages of connecting the wall sheathing 77 to the single top plate 75 are to provide a means to transmit shear from the top to the bottom of the wall. A further advantage to said connection is to increase the load carrying capacity of single top plate 75 by increasing the effective depth of web 72.

In conventional construction double top plates are used to be able to distribute point loads from rafters or floor joists through the double top plates (as a beam) into the studs below. Another use for the conventional doubled top plates is to lap the joints of the plates and connect with enough nails to be able to transmit tension loads through the length of the double top plates. Both of these uses of double top plates are performed by single top plate 70 and 75 with less wood fiber, less installation labor and greater strength and continuity.

FIG. 12 shows another embodiment of the present invention as a portion of perimeter floor beam with a downwardly extended web 80. Web 82 is attached to continuous top cord 81 and continuous ledger 83 by gluing or mechanical fasteners to form perimeter floor beam with a downwardly extended web 80 that runs continuously along the edge of floor framing. Beam 80 is supported by ledger 83 bearing on a plurality of posts 87 attached to both ledger 83 and web 82 with mechanical fasteners and metal ties as necessary. Block 88 is attached to top cord 81, ledger 83, and web 82 by gluing or mechanical fasteners. The ends of a plurality of floor joists 84 bear on ledger 83 and are held in place with metal ties 85. The top corner of joists 84 are notched to accommodate continuous top cord 81. Floor sheathing 86 is attached to the top of floor joists and top cord 81 with mechanical fasteners.

The depth and thickness of web 82 is designed to accommodate the gravity load imposed by the floor framing and any wall loads from above. When web 82 is made deeper or thicker, beam 80 becomes stronger and therefore the supports may be spaced at greater intervals. In this embodiment the bottom portion of web 82 performs the duty of the bottom tension cord of the beam 80. When beam 80 is loaded as a simple beam the bottom portion of web 82 is in tension, therefore self aligning, and therefore it is not required to provide blocking at the bottom edge of web 82.

From FIG. 12 it can be seen that beam 80 has the advantages of consolidating the functions of perimeter floor beam, top plate, rim joist and blocking. A further advantage is providing a convenient and secure method of attachment and support of floor joists 84 to beam 80 without the use of conventional joist hangers. It can also be seen that beam 80 may be used to support an edge of a roof if floor joists 84 where instead rafters or roof trusses.

Summary, Ramifications, and Scope

Accordingly, the reader will see that the offset web composite beam invention can be used in a wide variety of applications in frame construction because of the simplicity and efficiency of the basic principle of this invention. The use of a bottom and top cords that align with, and are of similar sizes to, conventional construction members provide for this invention to be easily integrated into frame construction. The use of a web member that is comparable in thickness to, and aligned with, conventional wall sheathing provides for this web material to be used to resist both gravity loads and lateral loads. In addition, the figures show embodiments of the invention that consist of a single cord, either top or bottom attached to a web. These embodiments demonstrate uses which may be used in conventional construction or developed into new construction methods. Furthermore, the offset web composite beam has the additional advantages in that:

(a) it provides for an efficient use of materials by providing a method to use a deep web beam with thickened top and bottom cords;

(b) it provides the function of multiple components into one assembly;

(c) it provides for more efficient use of labor in erection of these assemblies rather than the multiple components;

(d) it provides a synergistic effect of combining multiple components in increased strength and reduced weight;

(e) it provides for a reduced number of conventional framing components to support various embodiments of the offset web composite beam.

Although the description above and the figures contain many specificities, these should not be construed as limiting in scope of the invention but as merely providing illustrations of some of the presently preferred embodiments of this invention. For example, the offset web composite beam may have other shapes, sizes and proportions depending on the application and loads imposed, etc. Various changes may be made to the embodiments shown herein, and other embodiments may be developed, without departing from the scope of the present invention which is limited only by the following claims.

Thus the scope of the invention should be determined by the appended claims and their legal equivalents, rather than by the examples given.

I claim:

1. A beam within a frame wall comprising:

an elongated, horizontal substantially compressive top cord aligned approximately vertically and laterally within the frame wall, said top cord having an outside face;

an elongated substantially tensile bottom cord extending parallel to and spaced from said top cord, said bottom cord having an outside face aligned with said outside face of said top cord;

a continuous shear transfer web extending substantially the length of and spanning across, said outside faces of said top and bottom cords, said transfer web attached to said outside faces of said top and bottom cords;

a plurality of horizontal or sloped framing members at spaced locations having ends bearing on an upper surface of said bottom cord;

a plurality of vertical framing members extending generally orthogonally between said top and bottom cords and attached to said transfer web;

a plurality of connective means attaching said ends of said horizontal, or sloped framing members to said upper surface of said bottom cord and to said vertical framing members.

* * * * *